US008195463B2

(12) United States Patent
Capman et al.

(10) Patent No.: US 8,195,463 B2
(45) Date of Patent: Jun. 5, 2012

(54) METHOD FOR THE SELECTION OF SYNTHESIS UNITS

(75) Inventors: François Capman, Versailles (FR); Marc Padellini, Paris (FR)

(73) Assignee: Thales (FR)

( * ) Notice: Subject to any disclaimer, the term of this patent is extended or adjusted under 35 U.S.C. 154(b) by 1040 days.

(21) Appl. No.: 10/970,731

(22) Filed: Oct. 22, 2004

(65) Prior Publication Data

US 2005/0137871 A1 Jun. 23, 2005

(30) Foreign Application Priority Data

Oct. 24, 2003 (FR) ..... 03 12494

(51) Int. Cl.
*G10L 13/00* (2006.01)
*G10L 21/00* (2006.01)
*G10L 19/00* (2006.01)

(52) U.S. Cl. ..... 704/258; 704/500; 704/502; 704/503; 704/504; 704/268

(58) Field of Classification Search ..... 704/258, 704/268, 500–504
See application file for complete search history.

(56) References Cited

U.S. PATENT DOCUMENTS

| | | | | |
|---|---|---|---|---|
| 6,161,091 | A * | 12/2000 | Akamine et al. | 704/258 |
| 6,574,593 | B1 * | 6/2003 | Gao et al. | 704/222 |
| 6,581,032 | B1 * | 6/2003 | Gao et al. | 704/222 |
| 6,980,955 | B2 * | 12/2005 | Okutani et al. | 704/258 |
| 7,529,660 | B2 * | 5/2009 | Bessette et al. | 704/205 |
| 7,895,046 | B2 * | 2/2011 | Andersen et al. | 704/503 |
| 2001/0021906 | A1 * | 9/2001 | Chihara | 704/258 |
| 2002/0065655 | A1 | 5/2002 | Nakache et al. | |
| 2003/0018473 | A1 * | 1/2003 | Ohnishi et al. | 704/258 |
| 2003/0125949 | A1 * | 7/2003 | Okutani et al. | 704/258 |

OTHER PUBLICATIONS

W. S. Kleijin, D. J. Krasinski et al."Improved Speech Quality and Efficient Vector Quantization in Self", Proc. ICASSP, pp. 155-158, 1998.*

M. Schroeder and B. Atal,"High Quality Speech at Very Low Bit Rates", Proc. ICASSP, pp. 937-940, 1985.*

M. Padellini, G. Baudoin and F. Capman: "Coddage de la parole a très bas debit par indexation d'unitès de taille variable" Sep. 23, 2003 Grenoble, France.

Baudoin G.; El Chami F: "Corpus based very low bit rate speech coding" 2003 IEEE International Conference on Acoustics, Speech, and Signal Processing Apr. 6-10, 2003, Hong Kong, China.

Lee, K. and R. Cox, "A Segmental Coder Based on a Concatenative TTS," Speech Communications, vol. 38, pp. 89-100, 2002.

Lee, K. and R. Cox, "A Very Low Bit Rate Speech Coder Based on a Recognition/Synthesis Paradigm," IEEE on ASSP, vol. 9, pp. 482-491, Jul. 2001.

Baudoin, G., F. Capman, J. Cerncoky, F. El-chami, M. Charbit, G. Chollet and D. Petrovska-Delacretaz, "Advances in Very Low Bit Rate Speech Coding using Recognition and Synthesis Techniques," TSD 2002, pp. 269-276, Brno, Czech Republic, Sep. 2002.

* cited by examiner

*Primary Examiner* — Richemond Dorvil
*Assistant Examiner* — Abdelali Serrou
(74) *Attorney, Agent, or Firm* — Lowe Hauptman Ham & Berner, LLP

(57) ABSTRACT

A method for the selection of synthesis units of a piece of information that can be decomposed into synthesis units, comprises at least the following steps for a considered information segment: determining the mean fundamental frequency value F0 for the information segment considered; selecting a sub-set of synthesis units defined as being the sub-set whose mean pitch values are the closest to the pitch value F0; applying one or more proximity criteria to the selected synthesis units to determine a synthesis unit representing the information segment.

20 Claims, 4 Drawing Sheets

METHOD FOR THE SELECTION OF SYNTHESIS UNITS

RELATED APPLICATIONS

The present application is based on France Application, and claims priority from Application Number 03 12494, filed on Oct. 24, 2003, the disclosure of which is hereby incorporated by reference herein in its entirety.

BACKGROUND OF THE INVENTION

1. Field of the Invention

The invention relates to a method for the selection of synthesis units.

It relates for example to a method for the selection and encoding of synthesis units for a speech encoder working at very low bit rates, for example at less than 600 bits/sec.

2. Description of the Prior Art

Techniques for the indexing of natural speech units have recently enabled the development of particularly efficient text-to-speech synthesis systems. These techniques are now being studied in the context of speech encoding at very low bit rates, in conjunction with algorithms taken from the field of voice recognition Ref. [1-5]. The main idea here consists of the identification, in the speech signal to be encoded, of a segmentation that is almost optimal in terms of elementary units. These units may be units obtained from a phonetic transcription, which has the drawback of having to be corrected manually for an optimum result, or corrected automatically according to criteria of spectral stability. On the basis of this type of segmentation, and for each of the segments, a search is made for the nearest synthesis unit in a dictionary obtained during a preliminary learning phase, and containing reference synthesis units.

The encoding scheme used consists in modeling the acoustic space of the speaker (or speakers) by hidden Markov models (HMM). These models, which are dependent on or independent of the speaker, are obtained in a preliminary learning phase from algorithms identical to those implemented in speech recognition systems. The essential difference lies in the fact that the models are learned on vectors assembled by classes automatically and not in a way that is supervised on the basis of a phonetic transcription. The learning procedure then consists in automatically obtaining the segmentation of the learning signals (for example by using the method known as temporal decomposition) and assembling the segments obtained into a finite number of classes corresponding to the number of HMMs to be built. The number of models is directly related to the resolution sought to represent the acoustic space of the speaker or speakers. Once obtained, these models are used to segment the signal to be encoded through the use of a Viterbi algorithm. The segmentation enables the association, with each segment, of the class index and its length. Since this information is not sufficient to model the spectral information, for each of the classes, a spectral path is selected from among several units known as synthesis units. These units are extracted from the learning base during its segmentation using the HMMs. The context can be taken into account, for example by using several sub-classes through which the transitions from one class to another are taken into account. A first index indicates the class to which the segment considered belongs, a second index specifies the sub-class to which it belongs as being the class index of the previous segment. The sub-class index therefore does not have to be transmitted, and the class index must be memorized for the next segment. The sub-classes thus defined make it possible to take account of the different transitions towards the class associated with the considered segment. To the spectral information, there is added information on prosody, namely the value of the pitch and energy parameters and their progress.

In order to obtain an encoder working at very low bit rates, it is necessary to optimize the allocation of the bits and hence of the bit rate between the parameters associated with the spectral envelope and the information on prosody. The classic method consists initially in selecting the unit that is nearest from a spectral viewpoint and then, once the unit is selected, in encoding the prosody information, independently of the selected unit.

SUMMARY OF THE INVENTION

The present invention proposes a novel method for the selection of the nearest synthesis unit in conjunction with the modeling and quantification of the additional information needed at the decoder for the restitution of the speech signal.

The invention relates to a method for the selection of synthesis units of a piece of information that can be decomposed into synthesis units. It comprises at least the following steps:

- for a considered information segment:
  - determining the mean fundamental frequency value F0 for the information segment considered,
  - selecting a sub-set of synthesis units defined as being the sub-set whose mean pitch values are closest to the pitch value F0,
  - applying one or more proximity criteria to the selected synthesis units to determine a synthesis unit representing the information segment.

The information is, for example, a speech segment to be encoded and the criteria used as proximity criteria are the fundamental frequency or pitch, the spectral distortion, and/or the energy profile and a step is executed for the merging or combining of the criteria used in order to determine the representative synthesis unit.

The method comprises, for example, a step of encoding and/or a step of correction of the pitch by modification of the synthesis profile.

This step of encoding and/or correction of the pitch may be a linear transformation of the profile of the original pitch.

The method is, for example, used for the selection and/or the encoding of synthesis units for a speech encoder working at very low bit rates.

The invention has especially the following advantages:

- The method optimizes the bit rate allocated to the prosody information in the speech domain.
- During the encoding phase it preserves, the totality of the synthesis units determined during the learning phase with, however, a constant number of bits to encode the synthesis unit.
- In an encoding scheme independent of the speaker, this method offers the possibility of covering all the possible pitch values (or fundamental frequencies) and of selecting the synthesis unit in partly taking account of the characteristics of the speaker.
- The selection can be applied to any system based on a selection of units and therefore also to any text-based synthesis system.

BRIEF DESCRIPTION OF THE DRAWINGS

Other features and advantages of the invention shall appear more clearly from the following description of a non-exhaustive example of an embodiment and from the appended figures, of which.

MORE DETAILED DESCRIPTION

For a clearer understanding of the idea implemented in the present invention, the following example is given as an illustration that in no way restricts the scope of the invention for a method implemented in a vocoder, especially the selection and encoding of synthesis units for a speech encoder working at very low bit rates.

It may be recalled that, in a vocoder, the speech signal is analyzed frame by frame in order to extract the characteristic parameters (spectral parameters, pitch, energy). This analysis is classically made by means of a sliding window defined on the horizon of the frame. This frame has a duration of about 20 ms, and the updating is done with a 10-ms to 20-ms shift of the analysis window.

During a learning phase, a set of hidden Markov models (HMM) is learnt. These models enable the modeling of the speech segments (set of successive frames) that can be associated with phonemes if the learning phase is supervised (with segmentation and phonetic transcription available) or spectrally stable sounds in the case of an automatically obtained segmentation. In this case, 64 HMM models are used. During the recognition phase, these models associate, with each segment, the index of the identified HMM and hence the class to which it belongs. The HMMs models are also used, by means of a Viterbi type algorithm, to carry out the segmentation and classification of each of the segments (membership in a class) during the encoding phase. Each segment is therefore identified by an index ranging from 1 to 64 that is transmitted to the decoder.

The decoder uses this index to retrieve the synthesis unit in the dictionary built during the learning phase. The synthesis units that constitute the dictionary are simply the sequences of parameters associated with the segments obtained on the learning corpus.

A class of the dictionary contains all the units associated with a same HMM model. Each synthesis unit is therefore characterized by a sequence of spectral parameters, a sequence of pitch values (pitch profile), and a sequence of gains (energy profile).

In order to improve the quality of the synthesis, each class (from 1 to 64) of the dictionary is divided into 64 sub-classes, where each sub-class contains the synthesis units that are temporally preceded by a segment belong to a same class. This approach takes account of the past context, and therefore improves the restitution of the transient zones from one unit towards the other.

The present invention relates notably to a method for the selection of a multiple-criterion synthesis unit. The method simultaneously takes account, for example, of the pitch, the spectral distortion, and the profiles of evolution of the pitch and the energy.

Figure 1:
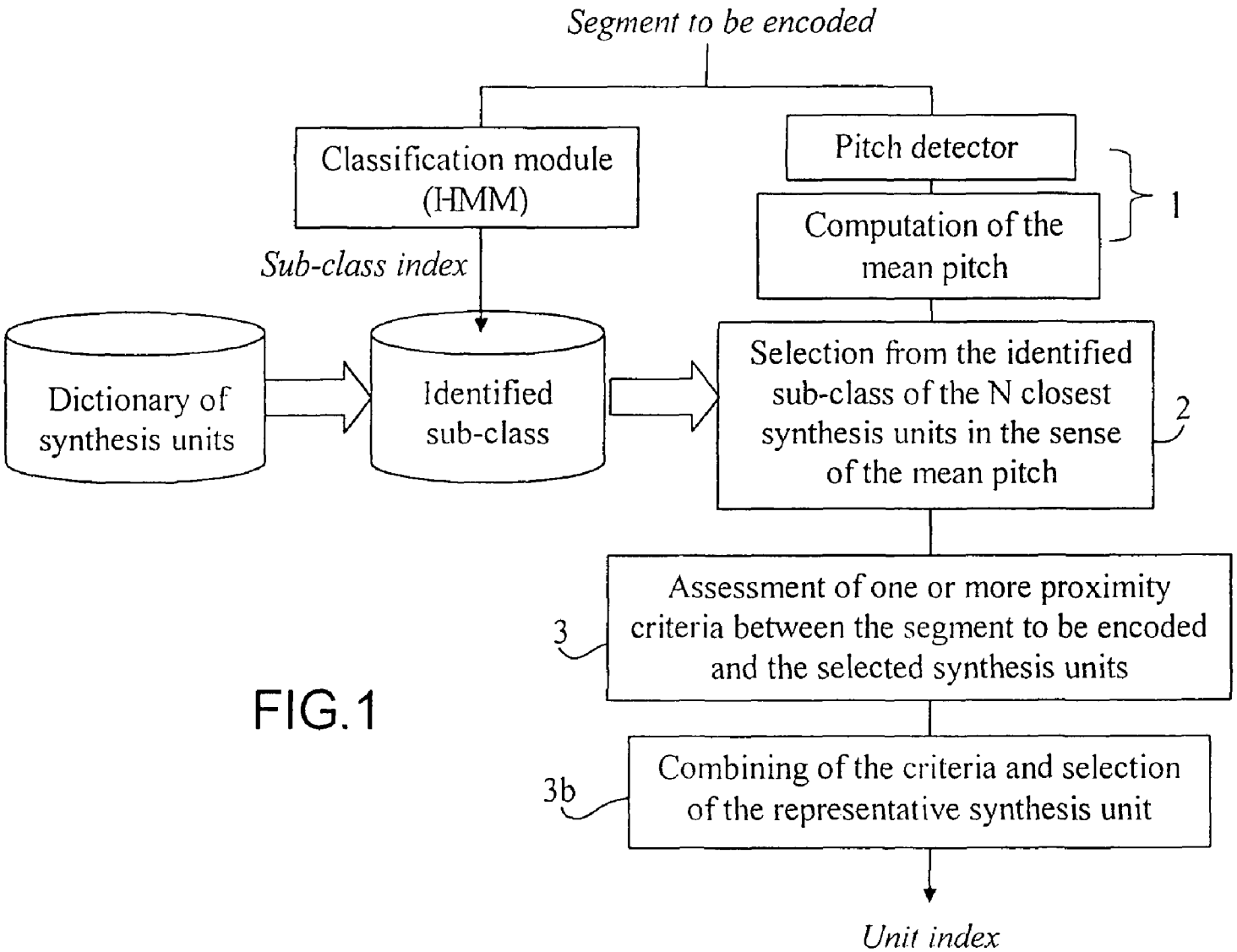
FIG. 1 is a drawing showing the principle of selection of the synthesis unit associated with the information segment to be encoded.

The method of selection for a speech segment to be encoded comprises for example the selection steps shown schematically in FIG. 1:

1) Extracting the mean pitch $F_0$ (mean fundamental frequency) on the segment to be encoded formed by several frames. The pitch is for example computed for each frame T, the pitch errors are corrected in taking account of the entire segment in order to eliminate the voiced/unvoiced detection errors and the mean pitch is computed on all the voiced frames of the segment.

It is possible to represent the pitch on five bits, using for example a non-uniform quantifier (logarithmic compression) applied to the pitch period.

The value of the reference pitch is obtained, for example, from a prosody generator in the case of a synthesis application.

2) With the mean pitch value $F_0$ being thus quantified, selecting a sub-set of synthesis units SE in the sub-class considered. The sub-set is defined as being the one whose mean pitch values are closest to the pitch value $F_0$.

In the above configuration, this leads to systematically choosing the 32 closest units according to the criterion of the mean pitch. It is therefore possible to retrieve these units at the decoder from the mean pitch transmitted.

3) Among the synthesis units thus selected, applying one or more criteria of proximity of similarity, for example the criterion of spectral distortion, and/or the energy profile criterion and/or the pitch criterion to determine the synthesis unit.

When several criteria are used, a merging step 3b) is performed to take the decision. The step for combining the different criteria is performed by linear or non-linear combination. The parameters used to make this combination may be obtained, for example, on a learning corpus in minimizing a criterion of spectral distortion on the re-synthesized signal. This criterion of distortion may advantageously include a perceptual weighting either at the level of the spectral parameters used or at the level of the distortion measurement. In the case of a non-linear weighting law, it is possible to use a connectionist network (for example an MLP or multilayer perceptron), fuzzy logic or any other technique.

4) Step for Encoding the Pitch

In one alternative embodiment, the method may comprise a step of pitch encoding by correction of the synthesis pitch profile explained in detail here below.

The criterion pertaining to the profile of evolution of the pitch is partly used to take account of the voicing information. However, it is possible to deactivate this criterion when the segment is totally unvoiced, or when the selected sub-class is also unvoiced. Indeed, mainly three types of sub-classes can be noted: sub-classes containing a majority of voiced units, sub-classes containing a majority of unvoiced units, and sub-classes containing a majority of combined units.

The method of the invention is not limited to optimizing the bit rate allocated to the prosody information but also enables the preservation, for the encoding phase, of the totality of the synthesis units obtained during the learning phase with a constant number of bits to encode the synthesis unit. Indeed, the synthesis unit is characterized both by the pitch value and by its index. This approach makes it possible, in an encoding scheme independent of the speaker, to cover all the pitch values possible and select the synthesis unit in partly taking account of the characteristics of the speaker. Indeed, for a same speaker, there is a correlation between the range of variation of the pitch and the characteristics of the voice conduit (especially the length).

It may be noted that the principle of selection of units described can be applied to any system whose operation is based on a selection of units and therefore also to a system of text-to-voice synthesis.

Figure 2:
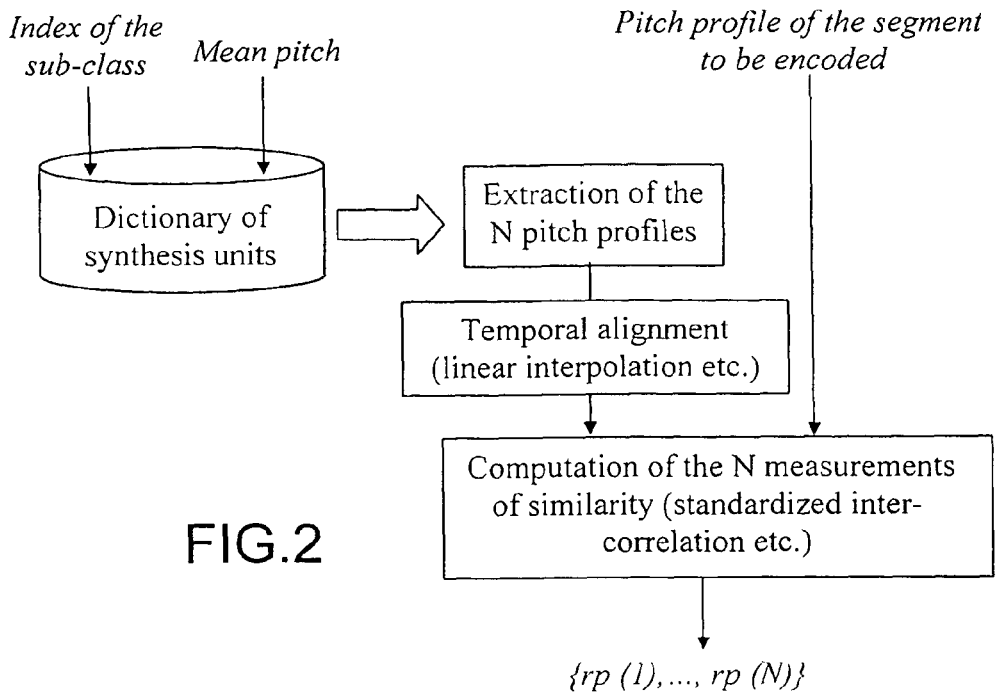
FIG. 2 is a drawing showing the principle of estimation of the criteria of similarity for the profile of the pitch.

FIG. 2 diagrammatically illustrates a principle of estimation of the criteria of similarity for the profile of the pitch.

The method comprises for example the following steps:

A1) the selection, in the identified sub-class of the dictionary, of the synthesis units and from the mean value of the pitch, of the N closest units in the sense of the criterion of the mean pitch. The rest of the processing will then be done on the pitch profiles associated with these N units. The pitch is extracted during the learning phase on the synthesis units and, during the encoding phase, on the signal to be encoded. There are many methods possible for the extraction of the pitch. However, hybrid methods, comprising a temporal criterion (AMDF, Average Magnitude Difference Function, or standardized self-correlation) and a frequency criterion (HPS, Harmonic Power Sum, comb structure, etc) are potentially more robust.

A2) the temporal aligning of the N profiles with that of the segment to be encoded, for example by linear interpolation of the N profiles. It is possible to use a more optimal alignment technique based on a dynamic programming algorithm (such as DTW or Dynamic Time Warping). The algorithm can be applied to the spectral parameters, the other parameters such as pitch, energy, etc being aligned synchronously with the spectral parameters. In this case, the information on the alignment path must be transmitted.

A3) the computing of N measurements of similarity between the N aligned pitch profiles and the pitch profile of the speech segment to be encoded to obtain the N coefficients of similarity $\{rp(1), rp(2), \ldots rp(N)\}$. This step can be achieved by means of a standardized intercorrelation.

The temporal alignment may be an alignment by simple adjustment of the lengths (linear interpolation of the parameters). By using a simple correction of the lengths of the synthesis units, it is possible especially not to transmit information on the alignment path, this alignment path being partially taken into account by the correlations of the pitch and energy profiles.

In the case of combined segments (where voice and unvoiced frames coexist within the same segment), the use of the unvoiced frames for which the pitch is arbitrarily positioned at zero take account to a certain extent of the progress of the voicing.

Figure 3:
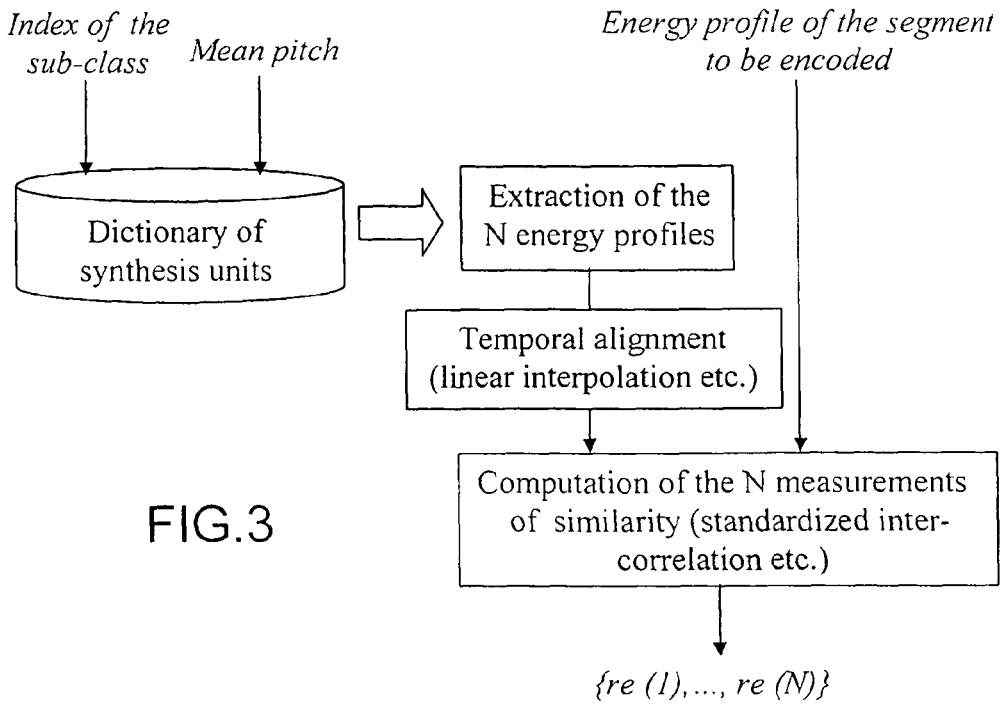
FIG. 3 is a drawing showing the principle of estimation of the criteria of similarity for the energy profile.

FIG. 3 provides a diagrammatic view of the principle of estimation of the criteria of similarity for the energy profile.

The method comprises for example the following steps:

A4) the extracting of the profiles of evolution of energy for the N units selected as indicated here above, namely according to a criterion of proximity of the mean pitch. Depending on the technique of synthesis used, the energy parameter used may correspond either to a gain (associated with an LPC type filter for example) or an energy value (the energy computed on the harmonic structure in the case of a harmonic/stochastic modeling of the signal). Finally, the energy can advantageously be estimated synchronously with the pitch (one energy value per pitch period). The energy profiles are precomputed for the synthesis units during the learning phase.

A5) the temporal aligning of the N profiles with that of the segment to be encoded, for example by linear interpolation, or by dynamic programming (non-linear alignment) similarly to the method implemented to correct the pitch.

A6) the computing of N measurements of similarities, between the N profiles of aligned energy values and the energy profile of the speech segment to be encoded to obtain the N coefficients of similarity $\{re(1), re(2), \ldots, re(N)\}$. This step can also be performed by means of a standardized intercorrelation.

Figure 4:
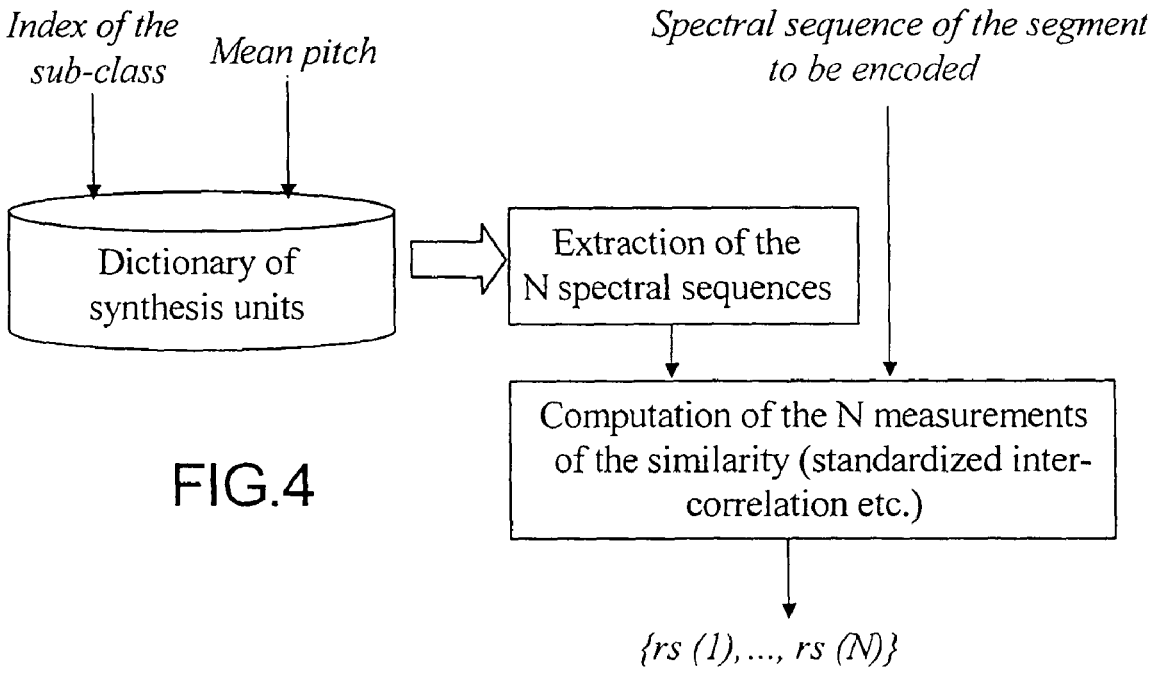
FIG. 4 is a drawing showing the principle of estimation of the criteria of similarity for the spectral envelope.
Figure 5:
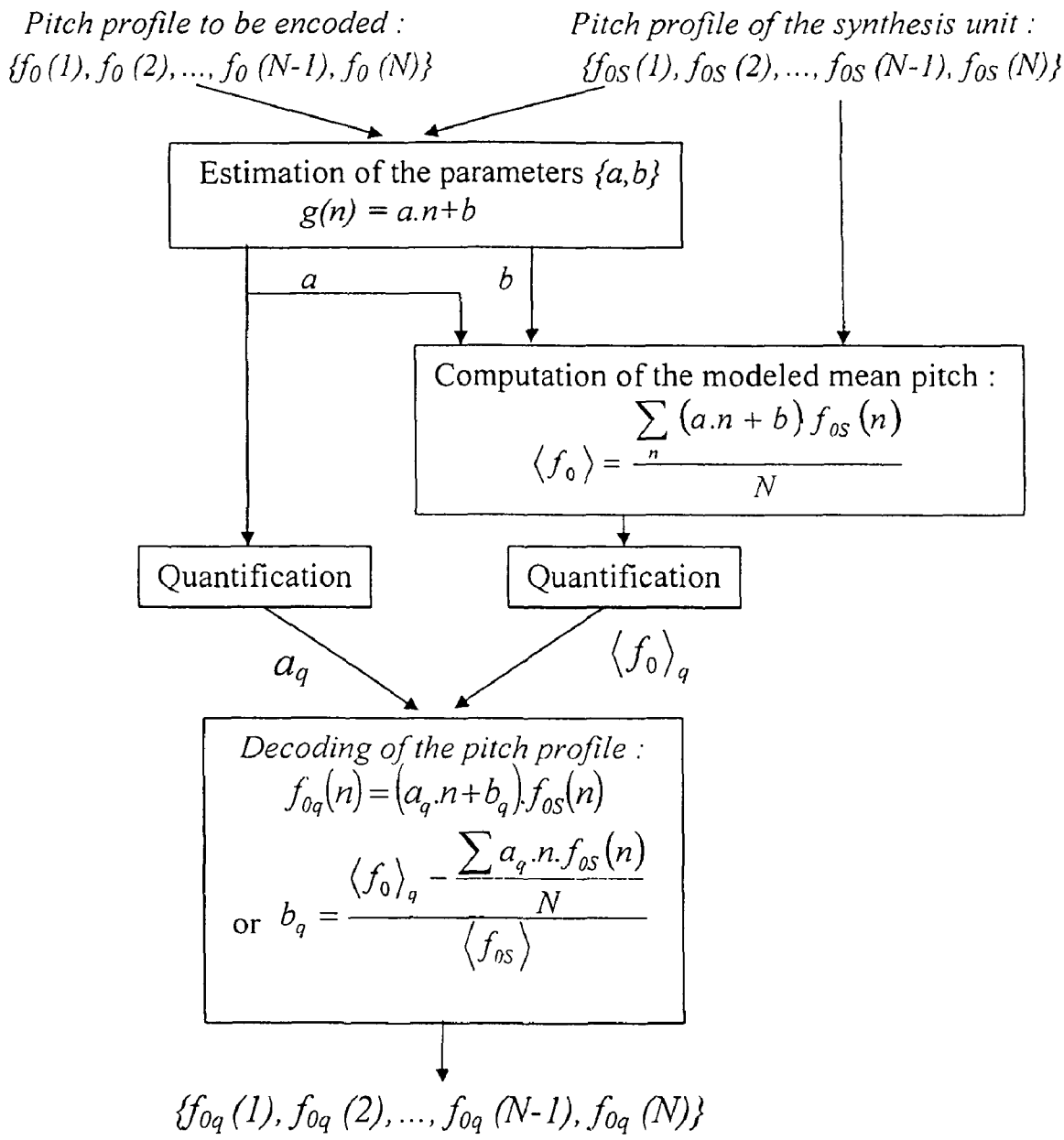
FIG. 5 is a drawing showing the principle of the encoding of the pitch by correction of the synthesis pitch profile.

FIG. 4 gives a diagrammatic view of the principle of estimation of the criteria of similarity for a spectral envelope.

The method comprises the following steps:

A7) the temporal aligning of the N profiles,

A8) the determining of the profiles of evolution of the spectral parameters for the N selected units as indicated here above, i.e. according to a criterion of proximity of the mean pitch. This entails quite simply computing the mean pitch of the segment to be encoded, and considering the synthesis units of the associated sub-class (current HMM index to define the class, preceding index HMM to define the sub-class) that have a mean pitch in proximity.

A9) the computing of N measurements of similarities, between the spectral sequence of the segment to be encoded and the N spectral sequences extracted from the selected synthesis units to obtain the N coefficients of similarity $\{rs(1), rs(2), \ldots, rs(N)\}$. This step may be performed by means of a standardized intercorrelation.

The measurement of similarity may be a spectral distance.

The step A9) comprises for example a step in which all the spectra of a same segment are averaged together and the measurement of similarity is a measurement of intercorrelation.

The criterion of spectral distortion is, for example, computed on harmonic structures re-sampled at constant pitch or re-sampled at the pitch of the segment to be encoded, after interpolation of the initial harmonic structures.

The criterion of similarity will depend on the spectral parameters used (for example the type of parameter used to represent the envelope). Several types of spectral parameters may be used, inasmuch as they can be used to define a measurement of spectral distortion. In the field of speech encoding, it is common practice to use the LSP (Line Spectral Pair) or LSF (Line Spectral Frequencies) parameters derived from an analysis by linear prediction. In voice recognition, it is the cepstral parameters that are generally used and they may be either derived from linear prediction analysis (LPCC, Linear Prediction Cepstrum Coefficients) or estimated from a bank of filters often on a perceptual scale of the Mel or Bark type (MFCC, Mel Frequency Cepstrum Coefficients). It is also possible, inasmuch as a sine modeling of the harmonic component of the speech signal is used, to make direct use of the amplitudes of the harmonic frequency. Since these parameters are estimated as a function of the pitch, they cannot be used directly to compute a distance. The number of coefficients obtained is indeed variable as a function of the pitch, unlike the LPCC, MFCC or LSF parameters. A pre-processing operation then consists in estimating a spectral envelope from the harmonic amplitudes (spline type polynomial or linear interpolation) and in re-sampling the envelope thus obtained, by using either the fundamental frequency of the segment to be encoded or a constant fundamental frequency (100 Hz for example). A constant fundamental frequency enables the precomputation of the harmonic structures of the synthesis units during the learning phase. The re-sampling is then done solely on the segment to be encoded. Furthermore, if the operation is limited to a temporal alignment by linear interpolation it is possible to average the harmonic structures on all the segment considered. The measurement of similarity can then be estimated simply from the mean harmonic structure of the segment to be encoded, and that of the synthesis units considered. This measurement of similarity may also be a standardized intercorrelation measurement. It can also be noted that the re-sampling procedure can be performed on a perceptual scale of the frequencies (Mel or Bark).

For the temporal alignment procedure, it is possible either to use a dynamic programming algorithm (DTW, Dynamic Time Warping), or to carry out a simple linear interpolation (linear adjustment of the lengths). Assuming that it is not sought to transmit additional information on the alignment path, it is preferable to use a simple linear interpolation of the parameters. The best alignment is then taken into account partly by means of the selection procedure.

The Encoding of the Pitch by Modification of the Synthesis Profile

According to one embodiment, the method has a step of encoding the pitch by modifying the synthesis profile. This consists in re-synthesizing a pitch profile from that of the selected synthesis unit and a linearly variable gain on the duration of the segment to be encoded. It is then enough to transmit an additional value to characterize the corrective gain on the entire segment.

The pitch reconstructed at the decoder is given by the following equation:

$$\hat{f}_0(n) = g(n) \cdot f_{0S}(n) = (a \cdot n + b) \cdot f_{0S}(n) \tag{1}$$

where $f_{0S}(n)$ is the pitch at the frame indexed n of the synthesis unit.

This corresponds to a linear transformation of the profile of the pitch.

The optimum values of a and b are estimated at the encoder in minimizing the root mean square error:

$$\sum_n e_0^2(n) = \sum_n \left[f_0(n) - \hat{f}_0(n)\right]^2 \tag{2}$$

giving the following relationships:

$$a = \frac{(S_4 \cdot S_2 - S_5 \cdot S_1)}{(S_2 \cdot S_2 - S_3 \cdot S_1)} \tag{3}$$

and $$b = \frac{(S_5 \cdot S_2 - S_4 \cdot S_3)}{(S_2 \cdot S_2 - S_3 \cdot S_1)} \tag{4}$$

where
$$S_1 = \sum_n f_{0S}(n) \cdot f_{0S}(n)$$
$$S_2 = \sum_n n \cdot f_{0S}(n) \cdot f_{0S}(n)$$
$$S_3 = \sum_n n^2 \cdot f_{0S}(n) \cdot f_{0S}(n)$$
$$S_4 = \sum_n f_0(n) \cdot f_{0S}(n)$$
$$S_5 = \sum_n n \cdot f_0(n) \cdot f_{0S}(n)$$

The coefficient a, as well as the mean value of the modeled pitch are quantified and transmitted:

$$a_q = Q[a] \tag{5}$$

$$f_{0q} = Q\left[\frac{\sum_n (a.n + b) \cdot f_{0S}(n)}{N}\right] \tag{6}$$

The value of the coefficient b is obtained at the decoder from the following relationship:

$$b_q = \frac{f_{0q} - \frac{\sum a_q \cdot n \cdot f_{0S}(n)}{N}}{\langle f_{0S} \rangle} \tag{7}$$

where $\langle f_{0S} \rangle$ is the mean pitch of the synthesis unit.

Note: this method of collection can of course be applied to the energy profile.

Example of Bit Rate Associated with the Encoding Scheme

The following is the data on the bit rate associated with the encoding scheme described here above:

Index of class on 6 bits (64 classes

Index of the units selected on 5 bits (32 units per sub-class)

Length of the segment on 4 bits (from 3 to 18 frames)

The mean number of segments per second is between 15 and 20; giving a basic bit rate ranging from 225 to 300 bits/sec for the preceding configuration. In addition to this basic bit rate, there is the bit rate necessary to represent the pitch and energy information.

Mean F0 on 5 bits

Corrective coefficient of the pitch profile on 5 bits

Corrective gain on 5 bits

The bit rate associated with the prosody then ranges from 225 to 300 bits/sec, giving a total bit rate of 450 to 600 bits/sec.

REFERENCES

[1] G. Baudoin, F. El Chami, "Corpus based very low bit rate speech coder", Proc. Conf. IEEE ICASSP 2003, Hong-Kong, 2003.

[2] G. Baudoin, J. Cernocky, P. Gournay, G. Chollet, "Codage de la parole a bas et très bas debit" (Speech encoding at low and very low bit rates), Annales des télécommunications, Vol. 55, N 9-10 Pages 421-456, November 2000.

[3] G. Baudoin, F. Capman, J. Cernocky, F. El-chami, M. Charbit, G. Chollet, D. Petrovska-Delacrétaz. "Advances in Very Low Bit Rate Speech Coding using Recognition and Synthesis Techniques", *TSD'* 2002, pp. 269-276, Brno, Czech Republic, September 2002.

[4] K. Lee, R. Cox, 'A segmental coder based on a concatenative TTS", in Speech Communications, Vol. 38, pp 89-100, 2002.

[5] K. Lee, R. Cox, "A very low bit rate speech coder based on a recognition/synthesis paradigm", in IEEE on ASSP, Vol; 9, pp 482-491, July 2001.

What is claimed is:

1. A method for selecting synthesis units of a piece of information, the information being a speech segment to be encoded that can be decomposed into synthesis units for a considered information segment, said method comprising the steps:

determining a mean fundamental frequency value F0 for the information segment considered, identifying a sub-set of the dictionary corresponding to the frequency F0, wherein said sub-set of the dictionary has N synthesis units, selecting a sub-set of P synthesis units in said N synthesis units of said identified sub-set of the dictionary, said sub-set of P synthesis units defined as being the closest units whose mean pitch values are the closest to the pitch value F0, the rest of the processing being done on the pitch profiles associated with said P units, with P inferior to N, $P=2^{nbits}$, and applying one or more proximity criteria to the selected synthesis units to determine a synthesis unit representing the information segment.

2. The method according to claim 1, wherein the criteria used as proximity criteria are the fundamental frequency or pitch, the spectral distortion, and/or the energy profile and a step is executed for the combining of the criteria used in order to determine the representative synthesis unit.

3. The method according to claim 1, wherein, for a speech segment to be encoded, the reference pitch is obtained from a prosody generator.

4. The method according to claim 2, wherein the estimation of the criterion of similarity for the profile of the pitch comprises the following steps:

A1) the selection, in the identified sub-set of the dictionary, of the synthesis units and from the mean value of the pitch, of the N closest units in the sense of the criterion of the mean pitch, A2) the temporal aligning of the N profiles with that of the segment to be encoded, A3) the computing of N measurements of similarity between the N aligned pitch profiles and the pitch profile of the speech segment to be encoded to obtain the N coefficients of similarity {rp(1), rp(2), . . . rp(N)}.

5. The method according to claim 4, wherein the temporal alignment is a temporal alignment obtained by DTW (dynamic time warp) programming or an alignment by linear adjustment of the lengths.

6. The method according to claim 4, wherein the measurement of similarity is a standardized intercorrelation measurement.

7. The method according to claim 2, wherein the estimation of similarity for the energy profile comprises the following steps:

A4) the determining of the profiles of evolution of energy for the N selected units according to a criterion of proximity of the mean pitch;

A5) the temporal aligning of the N profiles with that of the segment to be encoded;

A6) the computing of N measurements of similarities, between the N profiles of aligned energy values and the energy profile of the speech segment to be encoded to obtain the N coefficients of similarity {re(1), re(2), . . . , re(N)}.

8. The method according to claim 7, wherein the temporal alignment is a temporal alignment obtained by DTW (dynamic time warp) programming or an alignment by linear adjustment of the lengths.

9. The method according to claim 7, wherein the measurement of similarity is a standardized intercorrelation measurement.

10. The method according to claim 2, wherein the estimation of the criterion of similarity for the spectral envelope comprises the following steps:

A7) the temporal aligning of the N profiles with that of the segment to be encoded, A8) the determining of the profiles of evolution of the spectral parameters for the N selected units according to a criterion of proximity of the mean pitch, A9) the computing of N measurements of similarities, between the spectral sequence of the segment to be encoded and the N spectral sequences extracted from the selected synthesis units to obtain the N coefficients of similarity {rs(1), rs(2), . . . , rs(N)}.

11. The method according to claim 10, wherein the temporal alignment is a temporal alignment obtained by DTW (dynamic time warp) programming or an alignment by linear adjustment of the lengths.

12. The method according to claim 10, wherein the measurement of similarity is a standardized intercorrelation measurement.

13. The method according to claim 10, wherein the measurement of similarity is a measurement of spectral distance.

14. The method according to claim 10, wherein the step A9) comprises a step in which the set of spectra of a same segment is averaged and wherein the measurement of similarity is a measurement of intercorrelation.

15. The method according to claim 10, wherein the criterion of spectral distortion is computed on harmonic structures re-sampled at constant pitch or re-sampled at the pitch of the segment to be encoded, after interpolation of the initial harmonic structures.

16. The method according to claim 1, comprising a step of encoding and/or a step of correction of the pitch by modification of the synthesis profile.

17. The method according to claim 16, wherein step of encoding and/or correction of the pitch may be a linear transformation of the profile of the original pitch.

18. The use of the method according to claim 1 used for the selection and/or the encoding of synthesis units for a speech encoder working at very low bit rates.

19. The method according to claim 1, wherein said dictionary is divided into 64 sub-classes, where each sub-class includes the synthesis units that are temporally preceded by a segment belong to a same class.

20. The method according to claim 1, wherein a bit rate associated with the encoding scheme shows that Index of class on 6 bits (64 classes)

Index of the units selected on 5 bits (32 units per sub-class)

N=32 corresponding to the number of the $F_{0moyen}$.

* * * * *